US005390599A

United States Patent [19]

Matsumoto et al.

[11] Patent Number: 5,390,599

[45] Date of Patent: Feb. 21, 1995

[54] ON-LINE SHEETER OF PRINTING SYSTEM AND METHOD OF CHANGING LENGTH OF CUT

[75] Inventors: Kiyoshi Matsumoto; Takashi Okada, both of Tokyo, Japan

[73] Assignees: Nikka Kabushiki Kaisha; Niimura Insatsu Kabushiki Kaisha, both of Tokyo, Japan

[21] Appl. No.: 114,149

[22] Filed: Sep. 1, 1993

[30] Foreign Application Priority Data

Sep. 11, 1992 [JP] Japan ..... 4-269428

[51] Int. Cl.[6] ..... B41F 13/26

[52] U.S. Cl. ..... 101/226; 101/227; 101/483

[58] Field of Search ..... 101/224, 226, 227, 483, 101/216, 219

[56] References Cited

U.S. PATENT DOCUMENTS

| | | | |
|---|---|---|---|
| 3,808,971 | 5/1974 | Staamann | 101/226 |
| 3,899,946 | 8/1975 | Niepmann | 101/226 |
| 4,290,837 | 9/1981 | Bova | 101/226 |
| 4,512,256 | 4/1985 | Schriber et al. | 101/226 |
| 4,587,898 | 5/1986 | Welschiau | 701/226 |
| 4,736,446 | 4/1988 | Reynolds et al. | 101/227 |

FOREIGN PATENT DOCUMENTS

| | | | |
|---|---|---|---|
| 0257390 | 3/1988 | European Pat. Off. . | |
| 0494087A3 | 7/1992 | European Pat. Off. . | |
| 741743 | 12/1955 | United Kingdom | 101/227 |

*Primary Examiner*—Eugene H. Eickholt
*Attorney, Agent, or Firm*—Oliff & Berridge

[57] ABSTRACT

A sheeter which can cut a running printed sheet discharged from a web-fed rotary gravure press, a web-fed rotary forms press, or similar rotary press with higher accuracy is provided on-line. The sheeter can selectively carry out a change in the length of cut with the change of a printing plate cylinder. A drum roller, which has the same diameter as that of the plate cylinder in a printing unit or a diameter that is enlarged by an amount of the applied tension, is provided in such a way that it is exchangeable and lies on a sheet guide passage introducing the running printed sheet to a cutting section with the flying knife. The drum roller is rotationally driven synchronous with the plate cylinder by a driving shaft of the plate cylinder, and feeds the running printed sheet to the cutting section by winding it. When exchanging the plate cylinder, the existing drum roller is exchanged with another which has the same diameter as that of the plate cylinder to be changed or a diameter enlarged to compensate for the amount of applied tension.

7 Claims, 4 Drawing Sheets

ON-LINE SHEETER OF PRINTING SYSTEM AND METHOD OF CHANGING LENGTH OF CUT

BACKGROUND OF THE INVENTION

FIELD OF THE INVENTION

The present invention relates to an on-line sheeter of a printing system and to a method of changing a length of cut and, more particularly, to an on-line sheeter of a printing system which is designed so that it can cut running printed sheets discharged from a web-fed rotary gravure press or a web-fed rotary forms press, at a predetermined length while on-line with the press, and method of changing the predetermined length of the cut. The length of the cut is length of the sheet between two cuts.

Up to the present time, when exchanging plate cylinders and changing the length of cut in the operation of a web-fed rotary press for gravure or forms, the printing systems have been arranged in such a way the desired section of sheet could be obtained by providing a plurality of folding machines corresponding to the length of cut for folding various running sheets. The folding machines comprise a plurality of folding cylinders positioned on the running line of the sheets. Each of the folding cylinders includes a cutting blade for cutting sheets, a needle for supplying sections of sheet being cut or a striking blade, and a gripping apparatus introducing the section to a stacker. Alternatively, variable folding machines sometimes prepare sections of the sheet.

However, in such conventional systems, printed sheets sometimes cannot be fed to a folding machine. For example, in a case of label printing where the sections of the sheet are not fixed, the printed sheets cannot be discharged as a section. Such printed sheets are temporarily rewound on a rewinder, then each of desired lengths of cut is set in an off-line sheeter, and the sheets are cut one by one to be stacked. Such a sheeter introduces printed sheets supplied from a roll of rewound sheets to a flying knife through a guide roller, a compensate roller, and a drawing roller, and then cuts the sheets at predetermined sizes and introduces them to a stack section to pile. In this case, an adjustment of the variation in the length of cut is carried out by modifying a press length to a draw roller through adjustment of a compensate roller position and by controlling a rotating speed of the draw roller. Controlling the rotation of the draw roller is control of the circumferential speed, which speed is manually or automatically controlled.

The above-mentioned conventional sheeter, however, is arranged off-line and independent of a printing line. It performs a cutting operation after loading a rewound roll of the printed sheet, therefore, its working effectiveness is very low. Moreover, the sheeter itself needs to be changed to a model corresponding to its length of cut when changing the length of cut with an exchange of a printing plate cylinder (e.g., changing size A to B). Because of the above-mentioned disadvantages, there has been a problem that the conventional printing system is not only unable to cut running printed sheets discharged from a web-fed rotary gravure press using an on-line sheeter. Further, the system needs to be equipped with a sheeter of a model corresponding to the new length of cut when the length of cut is changed. To do otherwise, the system has to employ a sheeter which can vary a length of the cut while on-line. To do so a draw roller is controlled, using a separate driving power source, to inhibit the variation of a length of the cut. However, the printing speed of the press varies. Thus, controlling the rotation of the draw roller to adapt to the variation is very difficult, and the conventional printing system has a disadvantage that it cannot control the variation of the cut as a result.

SUMMARY OF THE INVENTION

Accordingly, with reference to the above problems, it is an object of the present invention to provide an on-line sheeter which can accurately cut running printed sheets discharged from a web-fed rotary gravure press, a web-fed rotary forms press, or similar presses while on-line, and permit changing a length of the cut with an exchange of the printing plate cylinder.

In order to achieve the above-mentioned object, an on-line sheeter of a press related to the present invention is an on-line sheeter which cuts, at a predetermined length, a running printed sheet supplied from a printing unit having a rotationally driven plate cylinder in a printing system, and comprises a sheet introducing guide section which feeds a running printed sheet discharged from the printing unit to a cutting section, the cutting section has a cutting means and cuts the running printed sheet from said sheet introducing guide section at a predetermined length, a drum roller is mounted on the sheet introducing guide section and has the same diameter as that of a plate cylinder in the printing unit, so that it synchronously rotates with the plate cylinder, and a nip roller which rotationally contacts with the drum roller and nips the running printed sheet passing between the nip roller and the drum roller. When changing a length of the cut of the running printed sheet which is supplied from the printing unit having the rotationally driven plate cylinder, the drum roller feeds the running printed sheet to the cutting section having a flying knife by nipping the sheet between a nip roller and itself, synchronously rotated by using a shaft for driving the plate cylinder of the printing unit, and the drum roller is changed to a drum roller having the same diameter as that of the plate cylinder or a diameter enlarged by an amount of applied tension simultaneously when exchanging the plate cylinder of the printing unit, then a length of cut will be changed.

In the above-mentioned arrangement, the sheeter has a drum roller having the same diameter as that of a plate cylinder, a nip roller rotationally contacting with the drum roller, and a running printed sheet continually fed from the printing unit is bitten between the rollers and fed to the cutting section. The drum roller rotates synchronous with the plate cylinder. The drum roller is exchanged with another drum roller having the same diameter as that of a new plate cylinder that is changed simultaneously whenever the drum roller is exchanged. As a result, a change in the length of a cut can be attained by exchanging the drum roller and plate cylinder at the same time. Accordingly, such a sheeter can be used on-line and the length of cut also can be changed and adjusted by exchanging the drum roller. Consequently, a drum roller can be driven through a transmission mechanism to so as to be automatically synchronous with a speed of a running printed sheet and a flying knife always can rotate synchronous with the plate cylinder.

According to the present invention, a change in the length of the cut can be provided at the same time when exchanging a plate cylinder. Moreover, there can be attained a very useful effect that setting the length of a cut can be easily made.

DESCRIPTION OF THE PREFERRED EMBODIMENT

An embodiment of the on-line sheeter of a press according to the present invention and a method of changing a length of cut, will be described in detail referring to the accompanying drawings.

Figure 1:
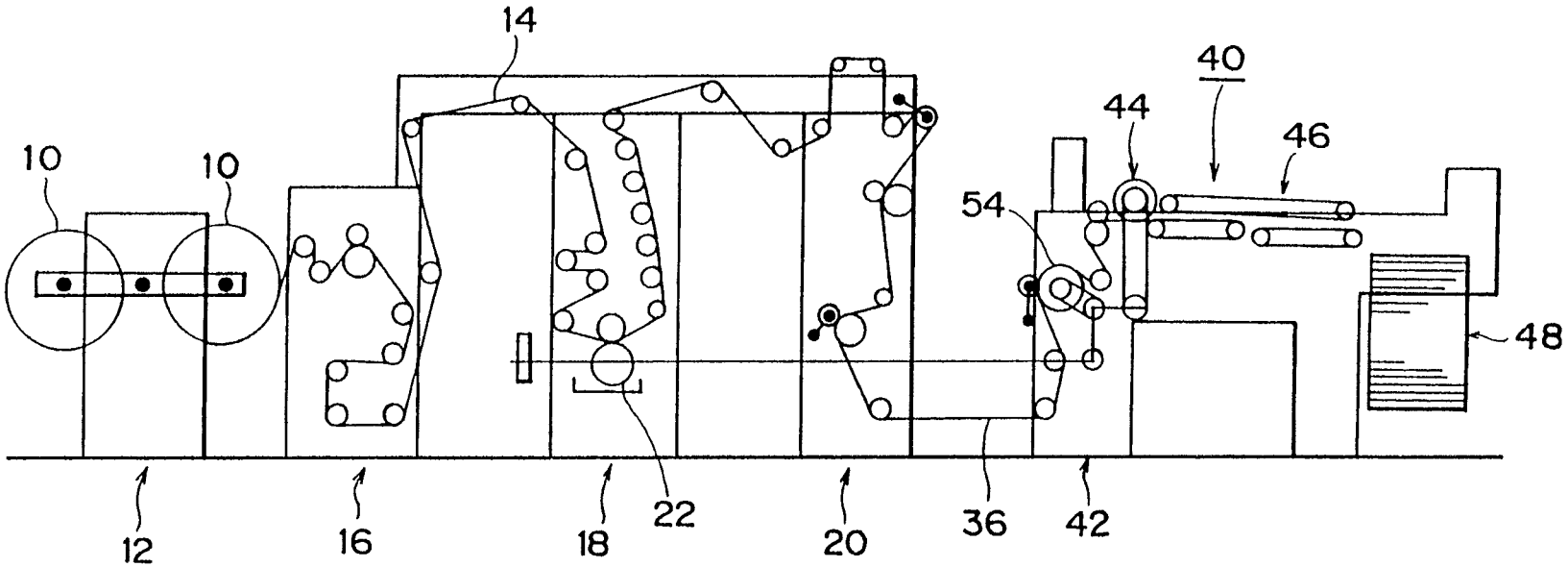
FIG. 1 is a block diagram of a web-fed rotary gravure press including an on-line sheeter of the embodiment.
Figure 2:
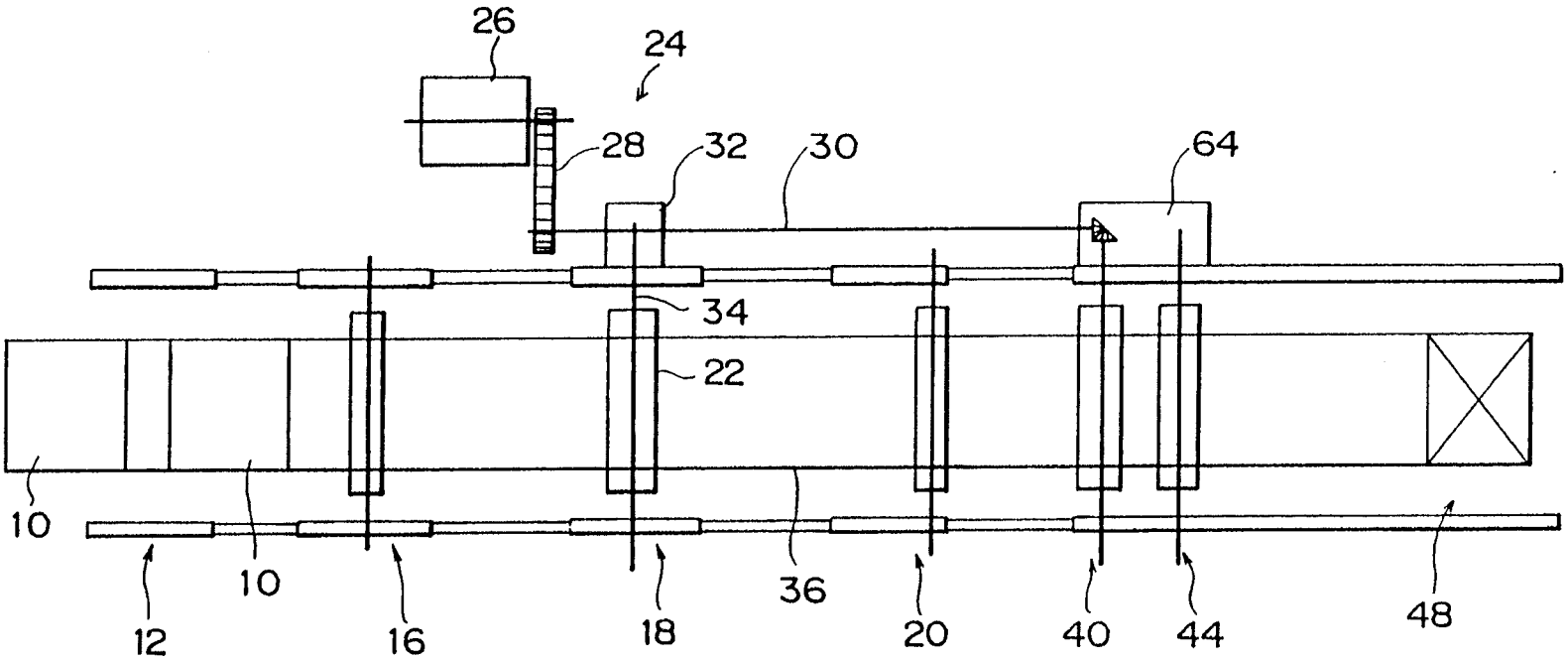
FIG. 2 is a plane block diagram of the same press.

FIGS. 1 and 2 are block diagrams of the press including an on-line sheeter of an embodiment of the invention. The embodiment of the invention is incorporated with a web-fed rotary gravure press for purposes of this description. The rotary press comprises a sheet feeding section 12 loading a pair of web rolls 10, an infeeding section 16 for introducing a web 14 supplied from the sheet feeding section 12 into a printing unit 18 for printing a sheet, and an outfeeding section 20 for controlling the tension applied to the sheet. The printing unit 18 includes a plate cylinder 22 for printing the sheet, a rotationally driving section 24 for rotationally driving the plate cylinder 22 is positioned at a side of the printing unit 18. In such an arrangement, the rotationally driving section 24 rotates a driving shaft 30 positioned parallel to the direction of feed of the web 14 through a driving motor 26 and a gear train 28. A rotating force of the driving axis 30 is transmitted through a gear box 32 to rotate a main axis 34 of the plate cylinder 22.

In order to directly introduce and cut a predetermined amount of print of a running printed sheet 36 discharged from such a rotary press, an on-line sheeter 40 according to the embodiment is placed on-line to follow the rotary press outfeeding section 20. The on-line sheeter 40 comprises a sheet introducing guide section 42 introducing the running printed sheet 36, a cutting section 44, a sheet discharging section 46, and a piling section 48. This particular arrangement will be described with reference to FIGS. 1 and 2.

Figure 3:
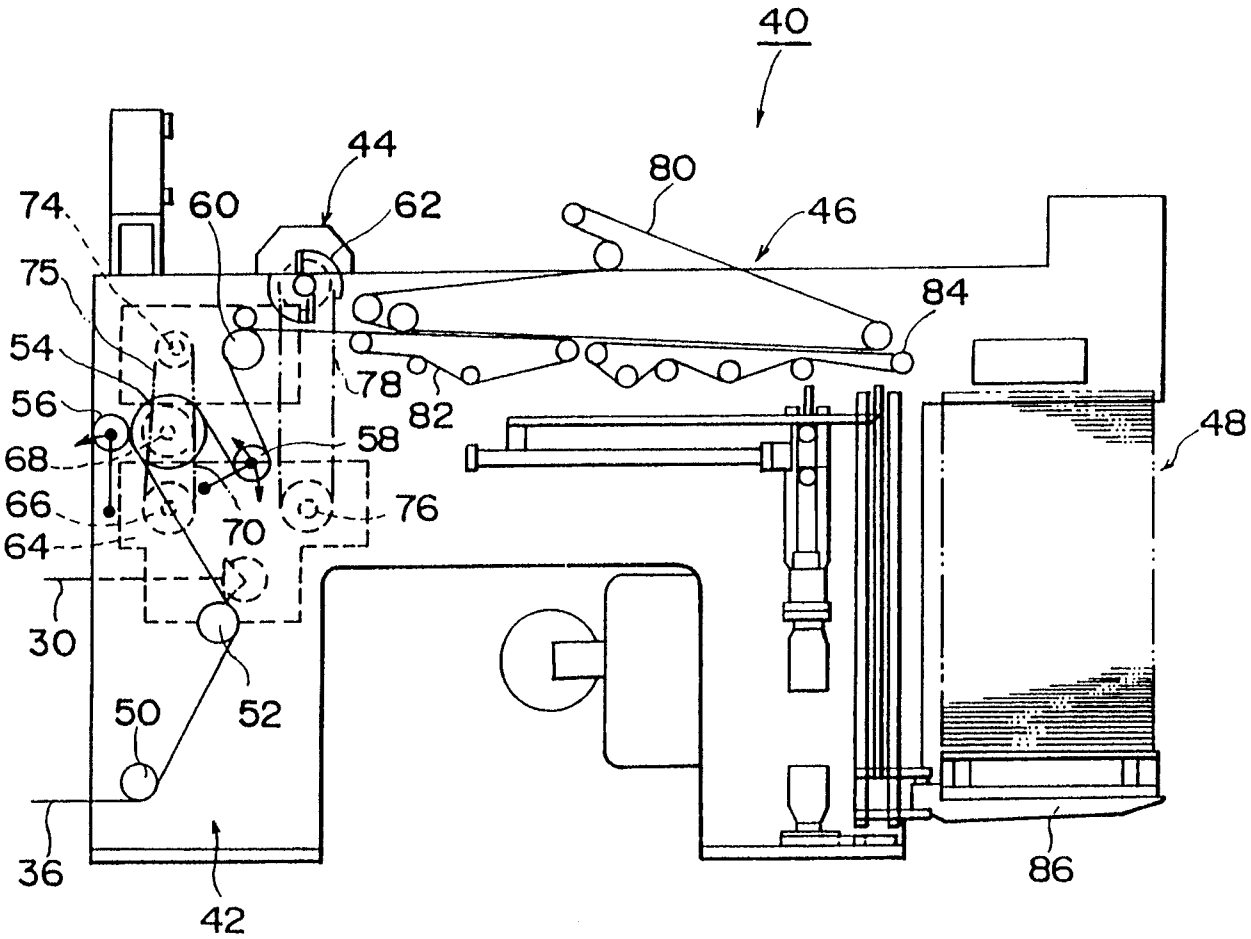
FIG. 3 is a sectional block diagram with reference to the embodiment.

The sheet introducing guide section 42 serves to receive the running printed sheet 36 as it is discharged from the rotary press and feeds it to the cutting section 44. The sheet introducing guide section 42 (as shown in FIG. 3) directs the running printed sheet 36, introduced from the front lower portion, upwards via a first guide roller 50 and a second guide roller 52. From the second guide roller 52, the running printed sheet 36 passed around a drum roller 54 which characterizes the embodiment. For feeding the running printed sheet 36, the drum roller 54 rotationally nips the printed sheet 36 between itself and a nip roller 56 rotationally contacting with the drum roller 54. The drum roller 54 is a rotary driving drum that determines the feeding speed of the running printed sheet 36 on the basis of a turning force transmitted from a driving power source. The running sheet 36 is discharged from the drum roller 54 and is fed to a drawing roller 60, which is positioned at an inlet port of the cutting section 44, by the way of a compensate roller 58. The cutting section 44 includes a flying knife 62 which is placed above the running printed sheet 36 adjacent and downstream from the discharge point of the drawing roller 60. The flying knife 62 cuts the running printed sheet 36 at a predetermined length of cut by its rotation and the cut running printed sheet is sent to the sheet discharging section 46.

The drum roller 54 has the same diameter as that of the plate cylinder 22 mounted on the printing unit 18 of the rotary press or has a diameter that is enlarged by an amount of applied tension (an amount of elongation percentage). The drum roller 54 is arranged so as to receive a rotating force from the driving shaft 30 of the rotationally driving section 24 which is disposed at the side of the printing unit 18 in order to rotationally drive the plate cylinder 22. The driving shaft 30 acts as an input shaft to a first gearbox 64 provided in the sheeter 40 that is on-line with the printing unit 18. The drum roller 54 can be rotationally driven through a speed change mechanism which is arranged so as to attain the same rotating-speed change percentage as that of the plate cylinder 22. The rotating-speed change percentage depends on a gear ratio of the gear box 64 and the turning ratio of a belt 70 which is wound between a first output shaft of the gear box 64 and a rotary shaft 68 of the drum roller 54. Thus, the drum roller 54 can be synchronously driven with the plate cylinder 22 and at the same rotating speed as that of the cylinder 22. Consequently, the speed introducing the running printed sheet 36 to the cutting section 44 corresponds to the printing speed of the rotary press.

Figure 4:
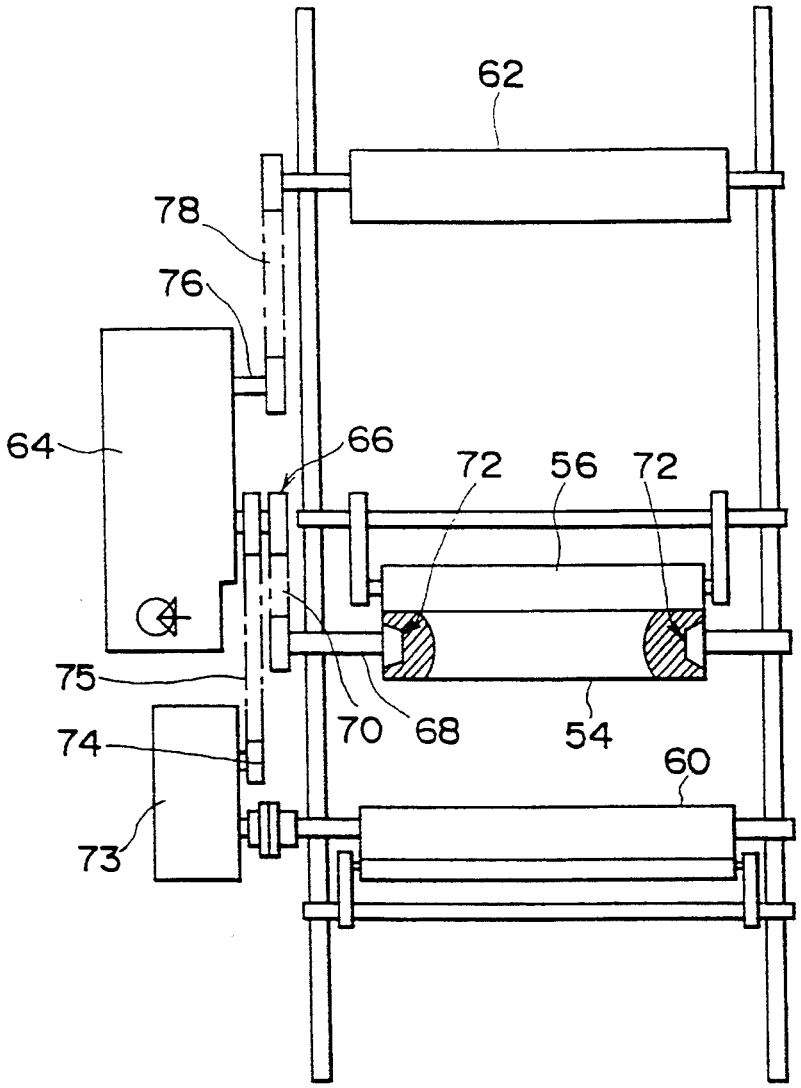
FIG. 4 is an enlarged block diagram of the sheet introducing guide section of the on-line sheeter.

In addition, the drum roller 54 is designed in such a way that it is detachable from the rotary axis 68. As shown in FIG. 4, tapered fitting portions 72 are provided on both ends of the drum roller 54 to detach it from the rotary axis 68. The rotary axis 68 is coupled to the drum roller 54 by fitting a key, spline, or serration into the tapered fitting portion, so that the turning force of the rotary axis 68 can be transmitted to the drum roller 54. The means are provided so as to allow another drum roller 54 and another plate cylinder 22, having the same diameters, to be exchanged for the currently used drum roller 54 and plate cylinder 22.

The rotating force transmitted from the driving shaft 30, of the rotationally driving section 24 in the printing press, also is used as a rotating force for the drawing roller 60 and the flying knife 62. As shown in the enlarged diagram of FIG. 4, the rotating force is transmitted to the drawing roller 60 by a continuous belt 75 extending between an input axis 74 of a second gear box 73 and the first output shaft 66 of the gear box 64. The rotating force is transmitted to the flying knife 62 by a continuous belt 78 extending between a shaft of the flying knife 62 and a second output shaft 76 of the first gear box 64. In this case, a non-stage transmission mechanism is built in the second gear box 73, which permits the rotating speed of the drawing roller 60 to be automatically regulated so as to be synchronous with the speed of the running printed sheet 36 fed from the related drum roller 54. This mechanism may be a known transmission mechanism which is programmed to change by varying the rotating speed relative to a change in the size of the drum roller 54. The printed sheet which is cut at the predetermined length in the sheet cutting section 44, is sent to the following sheet discharging section 46, which consists of an upper high-speed continuous belt 80, a lower high-speed continuous belt 82, and a low-speed continuous belt 84. The sheets are piled on an elevating forklift 86 of the piling section 48 provided in the final stage.

In the on-line sheeter 40 that is so arranged, the drum roller 54 has the same diameter as that of the plate cylinder 22 of the printing unit 18 or a diameter enlarged by the amount of tension applied to the running printed sheet 36 and is mounted on the rotary shaft 68. When starting the printing system, the running printed sheet 36 which is printed by the plate cylinder 22 in the rotary press is introduced to the sheet introducing guide section 42. The running printed sheet then passes between the drum roller 54 and the nip roller 56 via the guide rollers 50,52. The drum roller 54 is rotated by the rotary shaft 30 of the rotationally driving section 24 which acts as a rotationally driving axis, and its speed-change percentage is set to be equal to a speed-change percentage of the plate cylinder 22, therefore, the running printed sheet 36 supplied to the sheeter 40 can be fed to the drawing roller 60 at a feeding speed that is synchronous with the feeding speed of the running printed sheet 36 in the printing unit 18, when exchanging a plate cylinder 22 to change a printing size, the existing drum roller 54 is exchanged with another drum roller 54 having the same diameter, but enlarged by the amount of a sheet elongation percentage if appropriate, simultaneously. Thereby, even if the plate cylinder 22 is exchanged, the feeding speed in the sheeter 40 can be always synchronized with that of the printing unit 18 without complicated adjusting between the rotary press and the sheeter 40 for synchronizing them. Thus, the synchronization is attained easily.

In the sheeter 40, the drum roller 54 has the same diameter as that of the plate cylinder 22, and feeds the running printed sheet 36 continually supplied from the printing unit 18 to the cutting section 44 by nipping the running printed sheet between the drum roller 54 and the nip roller 56 which are rotationally contacting with each other. Since the drum roller 54 synchronously rotates in conjunction with the rotary shaft 30 and is exchanged with another drum roller 54 having the same diameter as that of a replacement plate cylinder 22 at the same time the plate cylinder 22 is exchanged, changing a length of cut is carried out simultaneously with the exchange of the drum roller 54. Accordingly, a length of the cut can be automatically adjusted by the exchange of the drum roller 54 and the sheeter 40 can be employed on-line. Especially, a label printing sheet which formerly was discharged as a section of print due to its undetermined size, need not be cut off-line after rewinding with a rewinder once, therefore the working effectiveness can be significantly improved.

In addition to changing the length of cut, the sheeter 40 is able to effect an accurate cutting process even though it is used as a sheeter whose length of cut is fixed to one length. That is, the drum roller 54 having the same diameter as that of the plate cylinder 22 is provided in the sheet introducing guide section 42, which section is arranged so as to synchronously drive the rotation of the drum roller 54 and the plate cylinder 22 by the rotary shaft 30. Thereby, the same variation in rotating speed occurs in the drum roller 54 as in the rotating speed of the plate cylinder 22. Further, the rotating speed of the drawing roller 60 which has the same driving source can be perfectly synchronized therewith. Accordingly, in comparison with the cases where only a drawing roller is manually or automatically controlled as in a conventional system, the accuracy of synchronization significantly increases, and the variation in the length of the cutting of a printed sheet is reduced, so that a sheet is cut with higher accuracy than could be previously obtained.

What is claimed is

1. An on-line sheeter of a printing system for cutting a running printed sheet fed from a printing unit having a rotationally driving plate cylinder at a predetermined length of cut, comprising:

a sheet introducing guide section for feeding said running printed sheet discharged from said printing unit to a cutting section;

a cutting section having a cutting means for cutting the running printed sheet fed from said sheet introducing guide section at the predetermined length of cut;

a drum roller mounted in said sheet introducing guide section, said drum roller having the same diameter as that of the plate cylinder in said printing unit;

means for rotating said drum roller synchronous with the plate cylinder; and a nip roller which rotationally contacts said drum roller and nips the running printed sheet passing between said nip roller and said drum roller.

2. The on-line sheeter of a printing system according to claim 1, wherein said drum roller is detachable for exchange when the plate cylinder is exchanged.

3. The on-line sheeter of a printing system according to claim 1, wherein said drum roller has a diameter enlarged by an amount of elongation percentage of the running printed sheet.

4. The on-line sheeter of a printing system according to claim 1, wherein said drum roller rotates synchronously with the plate cylinder by receiving a rotating force directly from a rotationally driving shaft of the plate cylinder.

5. An on-line sheeter of a printing system for cutting a running printed sheet fed from a printing unit having a rotationally driving plate cylinder at a predetermined length of cut, comprising:

a sheet introducing guide section for feeding the running printed sheet discharged from the printing unit to a cutting section;

a cutting section having a flying knife for cutting the running printed sheet fed from said sheet introducing guide section at the predetermined length of cut;

a drum roller mounted in said sheet introducing guide section, said drum roller provided with a diameter that is one of a diameter of the plate cylinder in the printing unit or a diameter enlarged by an amount of applied tension, said drum roller rotating synchronous with the plate cylinder; and a nip roller which rotationally contacts said drum roller to nip the running printed sheet passing between said nip roller and said drum roller.

6. An on-line sheeter of a printing system for cutting a running printed sheet fed from a printing unit having a rotationally driving plate cylinder at a predetermined length of cut, comprising:

a sheet introducing guide section for feeding the running printed sheet discharged from the printing unit to a cutting section;

a cutting section having a flying knife for cutting the running printed sheet fed from said sheet introducing guide section at a predetermined length of cut;

a drum roller mounted in said sheet introducing guide section, said drum roller having a diameter that is one of equal to a diameter of the plate cylinder in said printing unit or a diameter enlarged by an amount of applied tension, said drum roller is synchronously rotated by a rotating force received directly from a rotationally driving shaft of the plate cylinder and is exchangeably detachable from said sheet introducing guide section; and a nip roller which is touchable and separable from said drum roller to nip the running printed sheet passing between said nip roller and said drum roller by contacting said nip roller with said drum roller.

7. A method of changing a length of cut in a sheeter, of a running printed sheet fed from a printing unit having a rotationally driving plate cylinder, comprising the steps of:

rotating synchronously a drum roller, which feeds a running printed sheet to a cutting section having a cutting means by nipping the running printed sheet between a nip roller and said drum roller, by means of a shaft for driving the plate cylinder of the printing unit; and changing a length of cut by changing said drum roller to another drum roller having a one of a same diameter as that of a replacement plate cylinder or a diameter enlarged by an amount of applied tension to the running printed sheet simultaneously with exchange of the plate cylinder to the replacement plate cylinder in the printing unit.

* * * * *